US005691596A

United States Patent [19]

Yu

[11] Patent Number: 5,691,596

[45] Date of Patent: Nov. 25, 1997

[54] CHRISTMAS TREE LIGHT

[76] Inventor: Chuan Jen Yu, P.O. Box 82-144, Taipei, Taiwan

[21] Appl. No.: 593,927

[22] Filed: Jan. 30, 1996

[51] Int. Cl.[6] ..... H01R 33/00

[52] U.S. Cl. ..... 313/318.1; 313/318.05; 439/602; 439/611; 439/617; 362/123; 362/249; 362/389

[58] Field of Search ..... 313/318.1, 318.05, 313/318.01, 318.09; 439/602, 611, 617; 362/249, 389, 448, 806, 123, 391

[56] References Cited

U.S. PATENT DOCUMENTS

| | | | |
|---|---|---|---|
| 4,298,923 | 11/1981 | Lin | 362/249 X |
| 4,631,650 | 12/1986 | Ahroni | 313/1 |
| 4,807,098 | 2/1989 | Ahroni | 352/249 |
| 5,278,741 | 1/1994 | Ehrman | 362/249 X |
| 5,331,529 | 7/1994 | Huang | 313/318.1 X |
| 5,498,922 | 3/1996 | Chang | 313/318.1 |

FOREIGN PATENT DOCUMENTS

| | | | |
|---|---|---|---|
| 2230380 | 10/1990 | United Kingdom | 313/580 |

*Primary Examiner*—Ashok Patel
*Attorney, Agent, or Firm*—Alfred Lei

[57] ABSTRACT

A Christmas tree light including a plastic lamp holder defining an open chamber, and a bulb fastened to the open chamber of the lamp holder, wherein the lamp holder has two opposite transverse ribs inside the open chamber, the bulb has two opposite engagement faces forced into engagement with the periphery of the open chamber of the lamp holder, and two opposite transverse retaining grooves forced into engagement with the transverse ribs of the lamp holder.

1 Claim, 6 Drawing Sheets

CHRISTMAS TREE LIGHT

BACKGROUND OF THE INVENTION

1. Field of the Invention

This invention relates to Christmas tree light sets, and relates more particularly to a Christmas tree light for Christmas tree light sets which can be easily assembled and, which prevents displacement of the bulb relative to the lamp holder.

2. Description of the Prior Art

FIG. 6 shows the structure of a regular christmas tree light, which is comprised of a bulb A, and a plastic lamp holder B which holds the bulb A. The bulb A is fastened to the plastic lamp holder B by plugging. Because the bulb is fastened to the plastic lamp holder by plugging, it tends to fall out of the plastic lamp holder when vibrated during transportation. When the Christmas tree light is installed in an electric circuit, the bulb may be forced to rotate relative to the plastic lamp holder, causing the two contact legs of the bulb to contact each other and to further cause a short circuit. If to reduce the inner diameter of the plastic lamp holder in order to firmly secure the bulb in place, it will be difficult to plug the bulb into the plastic lamp holder.

SUMMARY OF THE INVENTION

This invention relates to Christmas tree light sets.

It is one object of the present invention to provide a Christmas tree light which is easy to assemble. It is another object of the present invention to provide a Christmas tree light which prevents rotary motion and axial displacement of the bulb relative to the lamp holder. According to one aspect of the present invention, the Christmas tree light comprises a plastic lamp holder defining an open chamber, and a bulb fastened to the open chamber of the lamp holder, wherein the lamp holder has two opposite transverse ribs inside the open chamber, the bulb has two opposite engagement faces forced into engagement with the periphery of the open chamber of the lamp holder, and two opposite transverse retaining grooves forced into engagement with the transverse ribs of the lamp holder. According to another aspect of the present invention, the engagement faces of the bulb have a respective non-circular profile fitting the periphery of the open chamber of the lamp holder. According to still another aspect of the present invention, the bulb has a smoothly arched bottom end convenient for insertion into the open chamber of the lamp holder. According to a yet further aspect of the present invention, the lamp holder has a profile made of any of a variety of shapes, fitting a particular socket.

DETAILED DESCRIPTION OF THE PREFERRED EMBODIMENT

Figure 1:
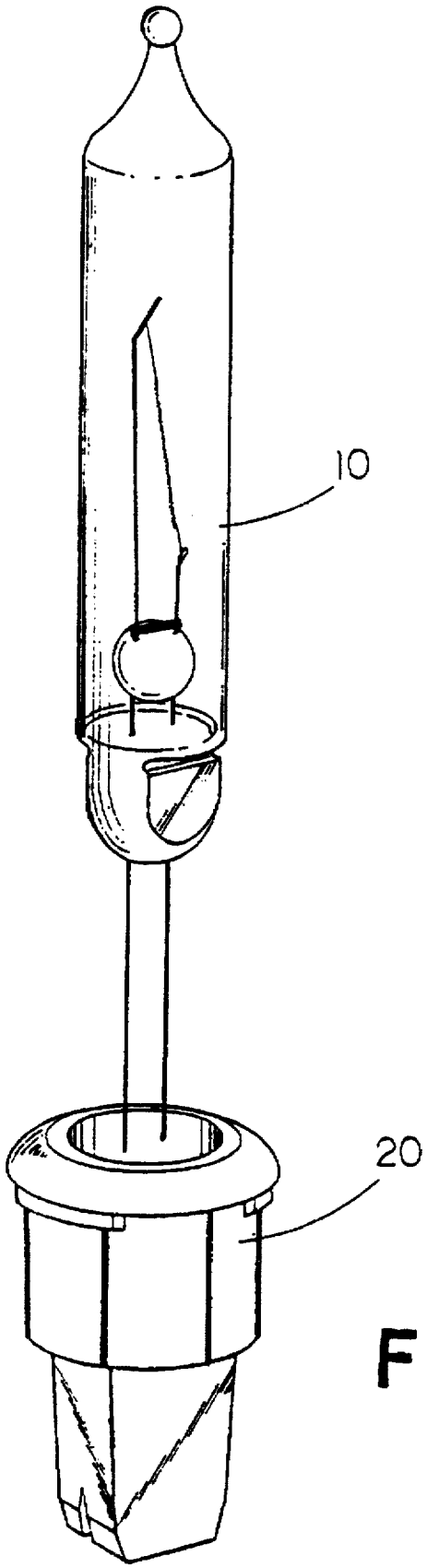
FIG. 1 is an exploded view of a Christmas tree light according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIG. 1, a Christmas tree light lamp in accordance with the present invention is generally comprised of a bulb 10, and a flexible plastic lamp holder 20 for holding the bulb 10.

Figure 2:
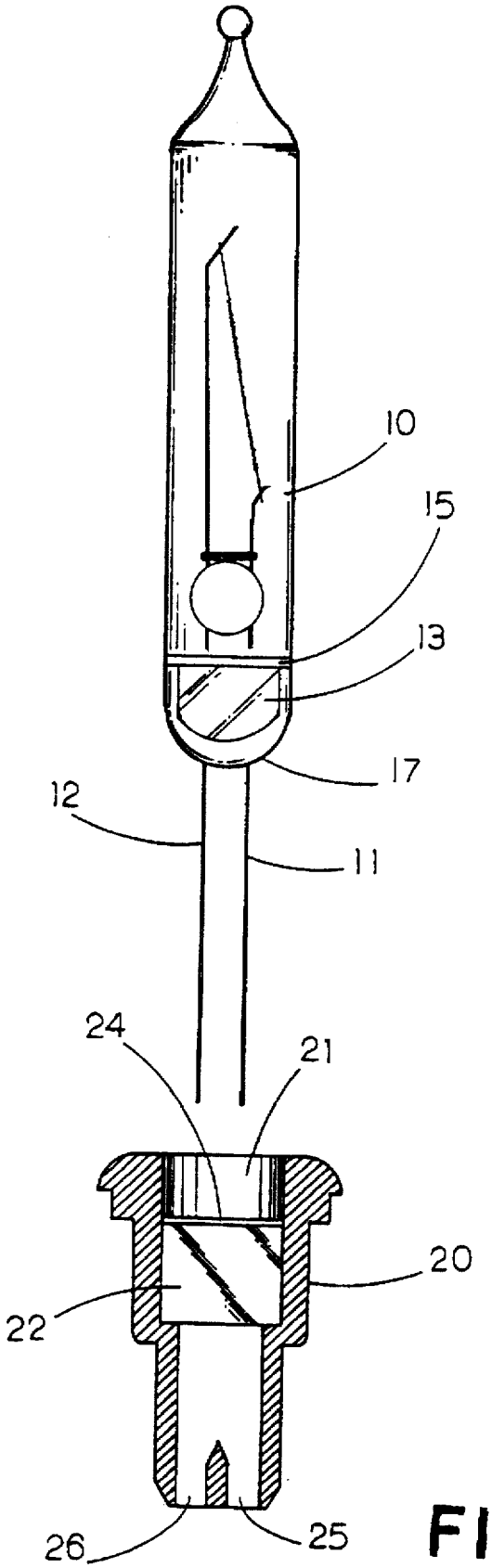
FIG. 2 is a sectional view of FIG. 1.
Figure 3:
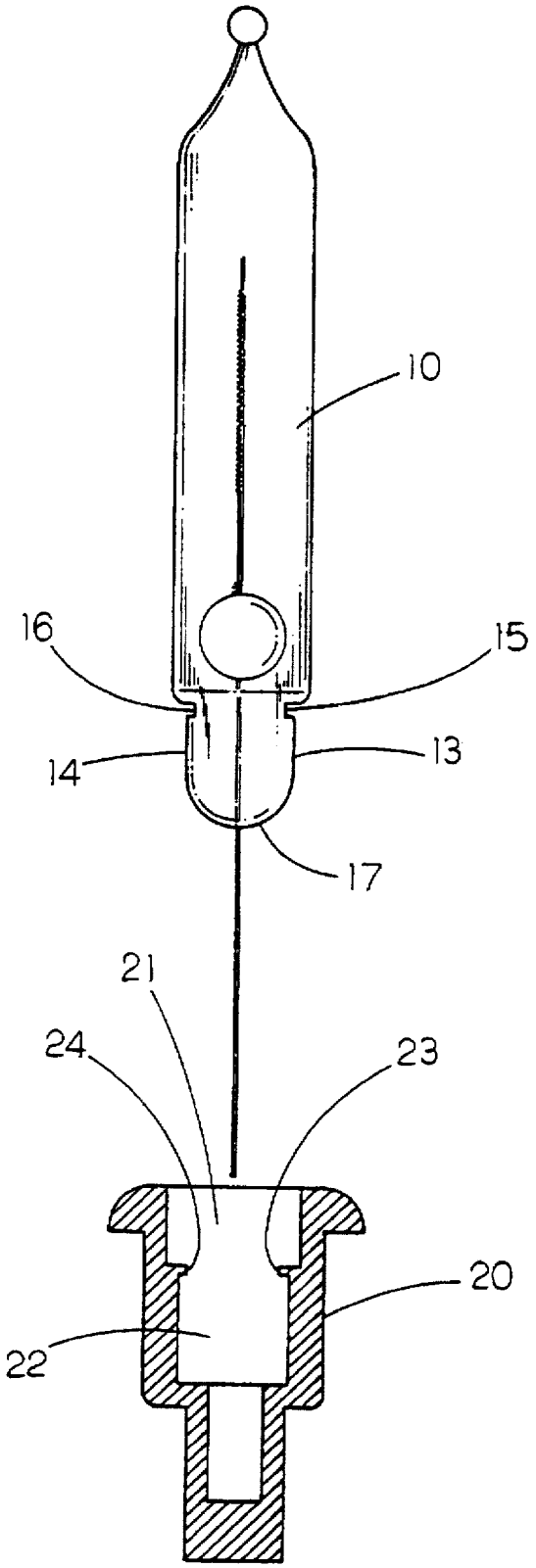
FIG. 3 is another sectional view of FIG. 1 viewed from another angle.

Referring to FIGS. 2 and 3, the bulb 10 comprises a smoothly arched bottom end 17, two contact legs 11, 12 downwardly extending from the smoothly arched bottom end 17, two opposite engagement faces 13, 14 at two opposite sides in parallel to the contact legs 11, 12 and adjacent to the smoothly arched bottom end 17, two transverse retaining grooves 15, 16 respectively disposed at two opposite sides above the engagement faces 13, 14. The lamp holder 20 comprises an inner chamber 22 and an outer chamber 21 connected on the inside at different elevations, two transverse ribs 23, 24 bilaterally raised from the inside wall and disposed between the inner chamber 22 and the outer chamber 21, and two separated contact leg outlets 25, 26 at the bottom remote from the outer chamber 21 and in communication with the inner chamber 22.

Figure 4:
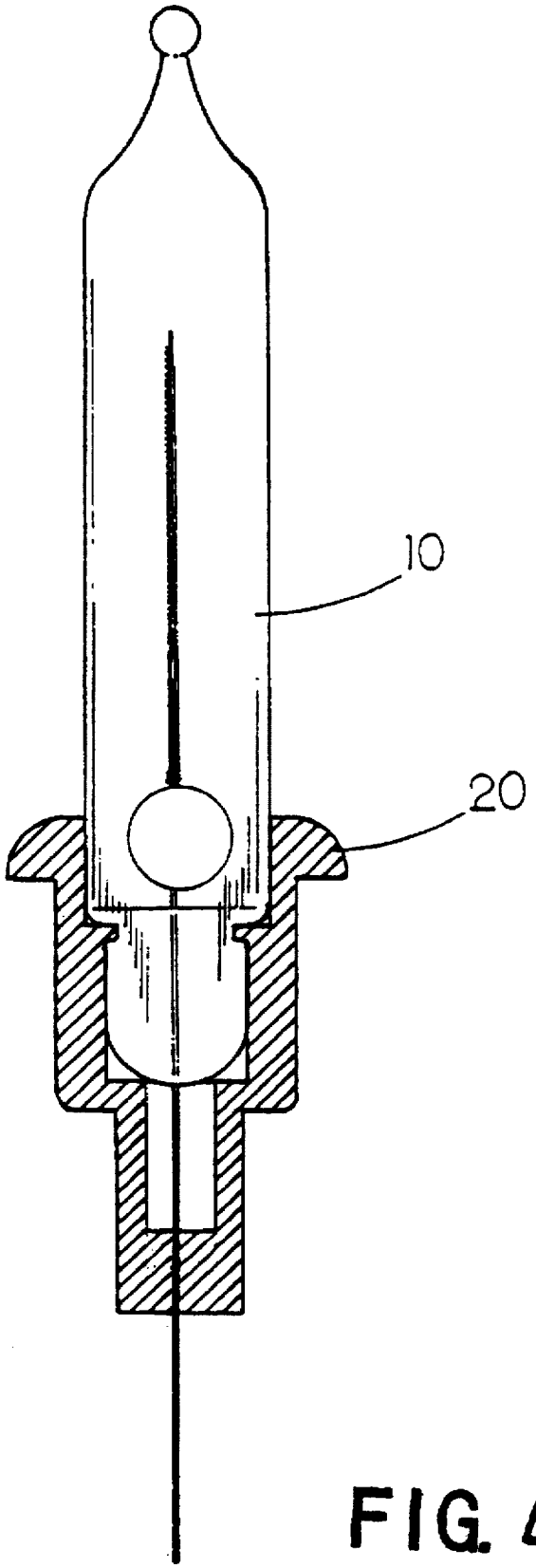
FIG. 4 is a sectional assembly view of the Christmas tree light shown in FIG. 1.

Referring to FIG. 4, and FIGS. 2 and 3 again, by means of the smoothly arched bottom end 17, the bulb 10 can be couveniently inserted into the outer chamber 21 and the inner chamber 22 of the lamp holder 20, permitting the contact legs 11, 12 to pass through the contact leg outlets 25, 26. When the bulb 10 is inserted into the lamp holder 20, the engagement faces 13, 14 of the bulb 10 are forced into engagement with the peripheral wall of the inner chamber 22 of the lamp holder 20, the transverse retaining grooves 15, 16 of the bulb 10 are respectively forced into engagement with the transverse ribs 23, 24 of the lamp holder 20, and the periphery of the lower end of the bulb 10 above retaining grooves 15 is forced into engagement with the periphery of the outer chamber 21 of the lamp holder 20.

Figure 5:
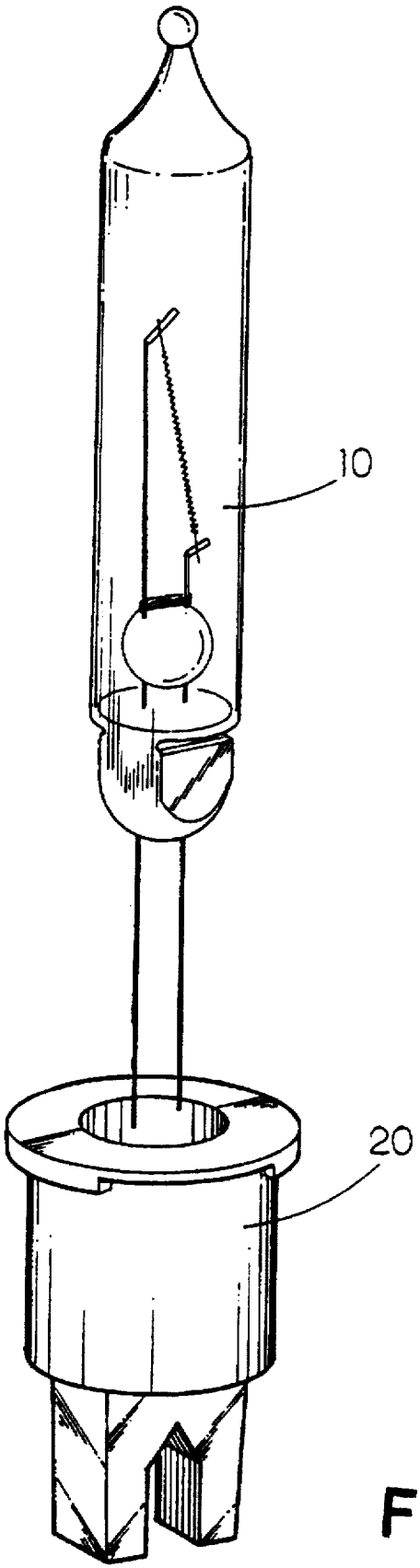
FIG. 5 shows an alternate form of the lamp holder according to the present invention.
Figure 6:
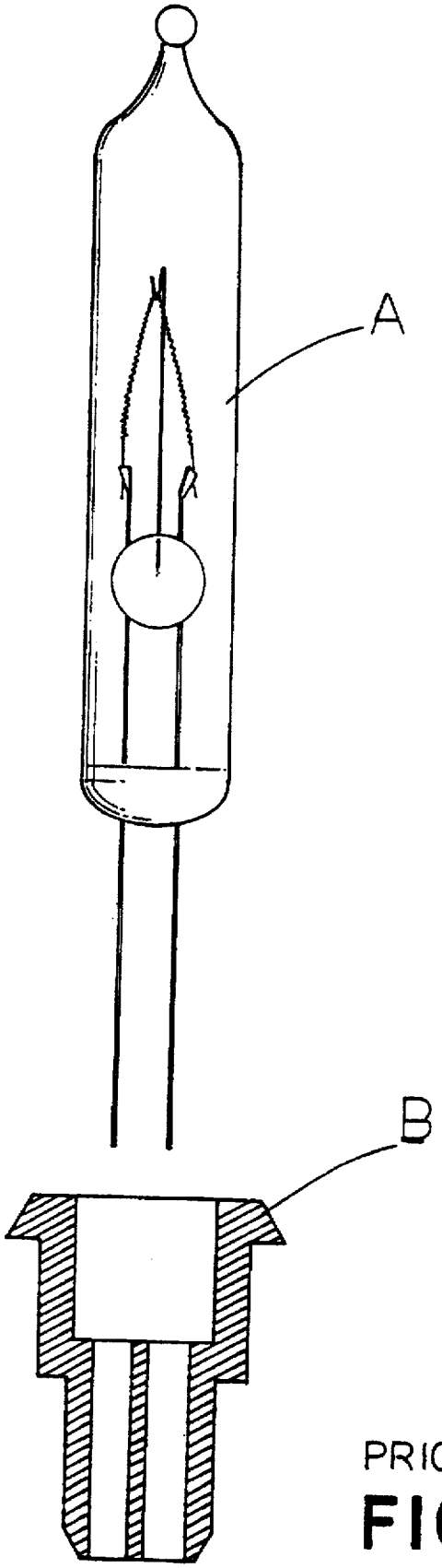
PRIOR ART FIG. 6
FIG. 6 is an exploded view in section of a Christmas tree light according to the prior art.

The flexible plastic lamp holder 20 may be variously shaped to fit a particular socket. FIG. 5 shows another form of the flexible plastic lamp holder 20.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A Christmas tree light comprising a lamp holder injection-molded from flexible plastics and defining a bulb mounting chamber, and a bulb fastened to the bulb mounting chamber of said lamp holder, wherein said lamp holder comprises two transverse ribs bilaterally disposed inside said bulb mounting chamber;

said bulb comprises two engagement faces disposed at two opposite sides near a bottom end thereof and forced into engagement with the periphery of the bulb mounting chamber of said lamp holder, and two transverse retaining grooves disposed at two opposite sides above said engagement faces and forced into engagement with the transverse ribs of said lamp holder;

the engagement faces of said bulb have a respective non-circular profile fitting the periphery of the bulb mounting chamber of said lamp holder; and said bulb has a smoothly arched bottom end inserted into the bulb mounting chamber of said lamp holder.

* * * * *